US005683520A

United States Patent [19]

Edgett et al.

[11] Patent Number: 5,683,520

[45] Date of Patent: Nov. 4, 1997

[54] METHOD OF CLEANING AN INK STORAGE MATERIAL

[75] Inventors: Norman S. Edgett, Rochester; Gary R. Fague, Canandaigua; Louis V. Isganitis, Rochester; Kurt B. Gundlach, Pittsford; Joseph R. Weber, Rochester, all of N.Y.

[73] Assignee: Xerox Corporation, Stamford, Conn.

[21] Appl. No.: 585,230

[22] Filed: Jan. 11, 1996

[51] Int. Cl.[6] ..... B08B 3/00; B08B 3/06; B08B 3/08

[52] U.S. Cl. ..... 134/22.19; 134/22.16; 134/22.1; 134/42; 134/26

[58] Field of Search ..... 134/22.16, 22.1, 134/42, 22.19, 26, 28

[56] References Cited

U.S. PATENT DOCUMENTS

| | | | |
|---|---|---|---|
| 4,824,487 | 4/1989 | Heffernan | 134/10 |
| 5,182,579 | 1/1993 | Haruta et al. | 346/140 R |
| 5,365,645 | 11/1994 | Walker et al. | 29/25.35 |
| 5,420,625 | 5/1995 | Dietl et al. | 347/85 |
| 5,441,561 | 8/1995 | Chujo et al. | 106/20 C |
| 5,562,876 | 10/1996 | Beach et al. | 264/321 |

OTHER PUBLICATIONS

Hawley's Condensed Chemical Dictionary, Van Nostrand Reinhold Company, 1993, pp. 486, 487 and 453.

*Primary Examiner*—Robert J. Warden
*Assistant Examiner*—Alexander Markoff

[57] ABSTRACT

Several methods are provided for cleaning felt or foam materials that are used to store and deliver ink, particularly ink supplied to ink jet printheads in an ink jet printing system. The felt materials are contaminated during manufacture, by various antistats, primarily phosphates. These antistats later react with the ink to create kogation and nozzle blocking problems as well as reduction of surface tension of the ink. The methods of the invention are directed to reducing the antistats left in the storage material after manufacture. In one method, the material is washed in heated softened water. Prior to loading the material in the wash, IPA is added to the heated wash. The material is washed through two Wash/Rinse cycles and then dried. The removal of the calcium in the wash water via softening prevents the precipitation of calcium-phosphate salts, which, when the material later contacts the ink, reduces nozzle clogging caused by these precipitates. The addition of the IPA increases removal of the phosphate antistats and greatly reduces the kogation and clogging problems.

In a second embodiment, the storage material is washed in tap water to which has been added the IPA as well as a chelating agent. The chelating agent prevents the calcium from forming a precipitate with the remaining antistats in the material and provides the same function against any calcium or other divalent metal ions that may be introduced during ink flow from material to printhead nozzle.

17 Claims, 1 Drawing Sheet

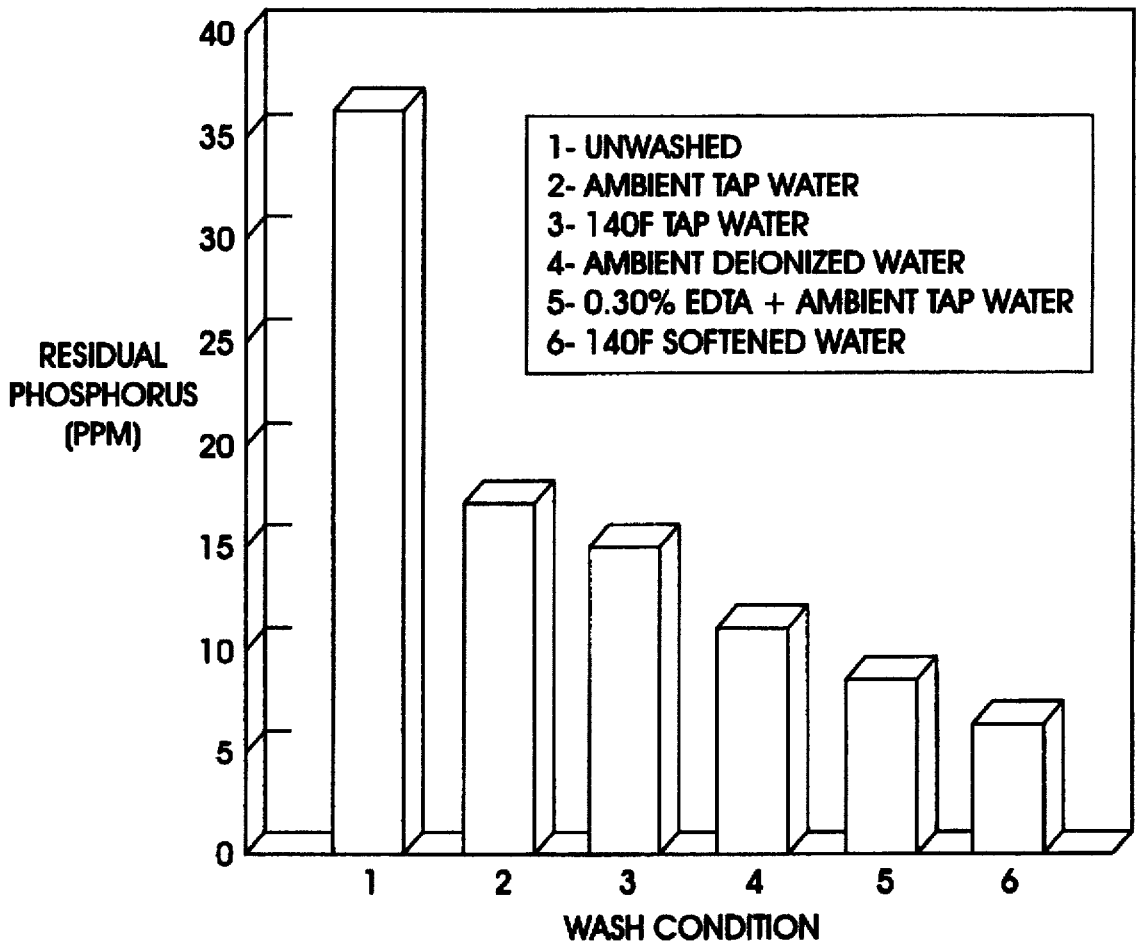
40
35
30
25
20
15
10
5
0
RESIDUAL PHOSPHORUS (PPM)
1- UNWASHED
2- AMBIENT TAP WATER
3- 140F TAP WATER
4- AMBIENT DEIONIZED WATER
5- 0.30% EDTA + AMBIENT TAP WATER
6- 140F SOFTENED WATER
1
2
3
4
5
6
WASH CONDITION

METHOD OF CLEANING AN INK STORAGE MATERIAL

BACKGROUND AND MATERIAL DISCLOSURE STATEMENT

The present invention relates generally to cleaning various materials that are subsequently used to store ink and, more particularly, to a washing method which removes contaminants from the material prior to contact with the ink.

In prior art printing systems which require delivery of ink to a recording head, foam or felt materials have been used to store the ink prior to delivery of the ink to the recording head. Similar materials are used in filters which are placed at the inlet to the printhead ink supply channels physically connected to the recording head. A preferred material for ink storage is a felt produced from polyester fiber. U.S. Pat. No. 5,420,625 describes, for example, a printhead cartridge which uses an ink storage material in the form of a needled felt of polyester fibers and a filter cloth of monofilament polyester. Other ink storage materials are disclosed in the listing of prior art contained in the Background section of this patent. The contents of the '625 patent are hereby incorporated by reference.

In prior art ink jet printing systems, a printhead is fluidly connected to an ink supply container with the ink being stored in the particular storage material. Ink is expelled through nozzles in the printhead nozzle face through, for example, selected energization of piezoelectric transducers, as disclosed in U.S. Pat. No. 5,365,645, or by heating resistors in an ink filled channel as disclosed, for example, in the '625 patent. A problem associated with the delivery of ink through the printhead nozzles is the extraction of additives that were added to the storage material during its manufacture. The ink gradually becomes contaminated resulting in possible premature cartridge failure, altering of the surface tension of the ink, clogging of the nozzles and, in the case of the thermal ink jet printers, kogation caused by deposits on the firing resistors.

The most significant of the additives found in commercially produced felt type of storage materials (hereinafter referred to as felt reservoirs) are so-called phosphate-based "antistats" such as alkyl phosphate surfactant, potassium alkyl phosphate and neutralized phosphoric acid esters. The total antistats in the reservoir is typically about 0.04% by weight applied as a coating to the surface of the reservoir. Depending on the ink composition, various techniques are known to reduce the contaminant effects of the felt reservoir additives. A simple washing in detergent with multiple rinsings provides some reduction but, for certain inks, may actually increase the nozzle clogging problem due to the precipitation of insoluble calcium salts into the ink. U.S. Pat. No. 4,824,487 discloses a technique for cleaning a polyurethane foam by exposing the foam to a solvent in a prescribed repetitive sequence. This method is not completely satisfactory as, in some cases, it may actually increase kogation.

SUMMARY OF THE INVENTION

It is, therefore, one object of the invention to produce a method for cleaning ink storage materials so as to reduce or eliminate the effects of extraction of the antistat additives into the inks.

It is a further object to enable a wide variety of inks to be used with the ink storage material cleaned by the methods of the invention.

It is a still further object to clean the ink storage material using simple, readily available cleaning agents.

It is another object to provide an improved wash procedure using ordinary tap water.

According to a first embodiment of the invention, a felt ink reservoir material is washed in softened water having a small percentage of isopropanol (IPA) added to it. The softened water eliminates the calcium contained in a conventional wash technique that formed the salts causing the nozzle clogging. The hot water and isopropanol actively extracts a large amount of the phosphate antistat materials from the felt.

In a second embodiment, tap water (containing calcium) is used for the wash, but the effects of the calcium are negated by adding a chelating agent to bind the divalent calcium ions and solubilize them.

More particularly, the invention relates to a first method for cleaning a material subsequently used to store ink, comprising the steps of:

a) filling a wash basin with heated softened water, b) adding an amount of isopropanol (IPA) to provide a concentration of IPA of between 1% and 10% by volume of the total wash, c) placing the material into the wash basin, d) cycling the wash through at least one Wash/Rinse cycle and e) drying the washed material.

The invention further relates to a second method for cleaning a material subsequently used to store ink, said material containing phosphate antistats, comprising the steps of:

a) filling a wash basin with ionized tap water, b) adding an IPA to a concentration of between 1% and 10% into the ionized water to form an $H_2O$/IPA solution, c) adding a chelating agent to a concentration of between 0.1% and 5% of the $H_2O$/IPA solution to form a wash, d) cycling the wash through at least one Wash/Rinse cycle and e) drying the washed material.

BRIEF DESCRIPTION OF THE DRAWING

The Figure shows the residual phosphorous content remaining in a felt reservoir following five wash conditions.

DESCRIPTION OF THE INVENTION

The invention will be explained in the context of analysis of the contamination problems of a felted polyester used as an ink storage material for a thermal ink jet printer and the cleaning techniques which reduce or eliminate the contamination problems. It is understood that the principles of the invention are applicable to other types of fiber and felted fiber ink storage materials as well as other types of ink delivery systems such as for piezoelectric ink jet printers.

A felted polyester is used as the ink storage material in the cartridge commercially sold by Xerox and under the name Xerox 4004. This material has been analyzed and found to contain, by weight, 0.04% of phosphate-based antistats including potassium alkyl phosphate, commercially sold by ICI Americas, Inc. as Atlas G-2200 and a neutralized phosphoric acid ester commercially sold by Hoechst-Celanese as Afilan PNL.

Various cleaning methods have proved unsatisfactory in reducing the problems created by extraction of the antistats into the ink once the ink is introduced into the storage material. As shown in the Figure, and in comparison with condition 1 (unwashed), a simple wash in ambient tap water halves the phosphorous content. While some improvement of the surface tension problem results, the nozzle clogging problem is exacerbated. Under analysis, it was found that the calcium from the tap water fixed the remaining phosphates to the fiber forming an insoluble Ca—P salt. The calcium content of the material was effectively tripled. The precipitated salt eventually made its way through the ink system and was deposited at the nozzle of the ink jet printhead worsening the nozzle clogging problem and resulting in ink misdirection. At very low concentrations, the Ca—P precipitate is colloidal but flocculates when heat is applied; e.g. when the resistors are pulsed to eject a drop through the nozzle, the Afilan material flocculates more readily than the Atlas because of its longer carbon chain length In a first embodiment of the invention, the felted polyester storage material (felt reservoir) used in the Xerox 4004 printhead was washed in water which had been softened (calcium and other divalent metal ions removed but with monovalent cations remaining) and to which a small quantity of isopropanol (IPA) had been added. Through experimentation, an optimum washing procedure was realized which resulted in a felt free of the calcium/phosphorous salt. In an unexpected result, the total phosphate antistats were lower than the amount remaining previously after a normal wash in tap water. In other words, the phosphate removal was more efficient when calcium was absent. A washed felt reservoir was placed in a print system using a cartridge using an ink from the Xerox 4004 printer. Measurements were made of ink surface tension and nozzle clogging; surface tension of the ink was found to stay at optimum levels, while the nozzle clogging and kogation were greatly reduced.

EXAMPLE I

Felt Washing in Soft Water

1. A commercial heavy duty washing machine such as a General Electric 9-cycle, 2 speed Model No. WWA8850RB-6WH was used for the felt wash and rinse. The machine temperature was set to "Hot Wash/Warm Rinse", the wash/spin speed to "Gentle/Gentle", the water level to "Extra Large" and the "Extra Cleaning-Heavy" cycle.

2. A water softener was connected to the hot water heater, the water softener providing water from which virtually all calcium and other divalent metal ions had been removed.

3. The machine basin was filled with the soft water heated to a temperature of 140° F.

4. When the basin was full, one liter of IPA was added.

5. About 750±50 felt reservoirs were loaded into the machine. When the "Wash/Rinse" cycle was completed and without removing the felt reservoir load, the "Extra Cleaning-Heavy" cycle was restarted, and a second "Wash/Rinse" cycle was completed.

6. The cleaned felts were dried in a conventional dryer. Following drying, three wash/dried felt reservoirs were selected for cleanliness testing.

7. The washed and dried felt was placed in a beaker to which was added 65 ml of 4004 ink completely covering the felt. The beaker was covered, and following a wait of between three and five hours, a surface tension measurement was made.

8. Using a Kruss I-10 Surface Tensiomat, the surface tension of the 4004 ink was measured, and a confirmation was made that it was at least 45 dynes/cm. The surface tension of an ink sample taken from a washed and dried felt reservoir subsequently filled with 4004 ink and used in a printer was measured. The surface tension was found to be not less than 45/dynes/cm.

9. A washed and dried felt reservoir was tested for phosphorous content. The results of this testing is shown in the Figure (wash condition 6)

RESULTS AND ANALYSIS

Following the above-described wash and test procedure, the following conclusions were made:

1. Washing the felt reservoir in hot softened water with the addition of IPA yielded the greatest removal of phosphates from the material; e,g., from 17 ppm in a normal wash with ambient tap water (wash condition 2) to 15 ppm and heated (140° F) tap water (wash condition 3) to 6.6 ppm in the hot softened water with the IPA (wash condition 6).

2. The amount of phosphate antistats still remaining in the washed felt was reduced sufficiently so that surface tension of the ink later contacting the felt was not reduced.

3. No kogation was observed in wash conditions 2–6 when using the felt reservoirs.

4. Since the nozzle clogging corner debris phenomena is due to the calcium salt of the phosphate antistats present in the washed felt reservoir, the nozzle clogging was greatly reduced since the felt reservoir was virtually free of Ca—P insoluble salts. This observation has been verified by using felt reservoirs washed by the method of Example I in the Xerox 4004 printer. Nozzle clogging has been found to be greatly reduced.

5. The addition of IPA to the tap water was an active extractant of the phosphorous; a range of 1% to 10% by volume and preferably between 2% and 5% was found to be effective.

6. An effective heating range for the softened water was found to be from 120° to 150° F.

7. An additional advantage of this wash method is that no foreign chemicals from detergents or cleaning agents are used, residue from which could be introduced into the ink with potentially harmful effects.

EXAMPLE II

Felt Reservoir Washing in Tap Water with Chelating Agent

1. The commercial washing machine used in the first example was used again to wash the same number (750±50) felts. The same machine settings were used.

2. The machine basin was filled with unheated tap water (normal municipal water supply).

3. Prior to complete fill, a liter of IPA was added together with a 0.25% (by weight of wash water) the trisodium salt of EDTA (ethylene diamine tetra-acetic acid) and 0.05% (by weight) EDTA (acid form). It is understood that other chelating agents of the alkylene diamine tetracarboxylic acid family could be used including primary, secondary and tertiary diamine acids. Factors affecting the choice of chelating agent, or agents, to use include: chelating ability, solubility, pH of solution (a pH of approximately 8 has been found optimum) and pH of discharge water from wash, the latter important for environmental considerations.

4. Following basin fill, the felt reservoirs were loaded into the machine and the two "Wash/Rinse" cycles completed with chelating agent added to each wash cycle. The cleaned reservoirs were dried in a conventional dryer.

5. The reservoirs were placed in Xerox 4004 printers, and the printheads performance monitored. The printhead life was within specifications and debris problems significantly reduced.

RESULTS AND ANALYSIS

1. The chelating agent sequesters the calcium and other divalent metal ions in the tap water and solubilizes them. Thus, when the wash water encounters the reservoir in the cleaning process, the calcium cannot form the insoluble Ca—P salt.

2. The residual chelating agent left in the reservoir provides continuing protection against precipitation of any remaining surfactants on the reservoir by other sources of calcium or other divalent metal ions as the ink is drawn from the felt and proceeds to the nozzles. Thus, an advantage of the wash with the chelating agent is that the chelating agent wash does not require a soft water source.

3. From the Figure, the chelating agent provides a phosphorous content of about 8 ppm (wash condition 5).

4. The concentration of the chelating agent can be between 0.1% and 5% of the $H_2O$/IPA solution and preferably between 0.2% to 0.5%.

In summary, and referring to the Figure, it is seen that both of the methods described in connection with Examples I and II (wash condition 6 and 5, respectively) significantly reduce the phosphorous content of the felt reservoir. A reduction in absolute units shows an approximately 80% reduction for each of the two cases from the phosphorous content of the original (unwashed) reservoir. Thus, for the typical polyester felt reservoir comprising 0.04% of antistats by weight, a cleaned and washed felt by either of the two methods would result in a felt reservoir which includes a reduced amount of antistats of approximately 0.008% by weight.

While the embodiment disclosed herein is preferred it will be appreciated from this teaching that various alternative modifications, variations or improvements therein may be made by those skilled in the art which are intended to be encompassed by the following claims:

What is claimed:

1. A method for cleaning a material used to subsequently store ink, comprising the steps of:

a) filling a wash basin with softened water, b) adding an amount of isopropanol (IPA) to provide a concentration of IPA of between 1% and 10% by volume of a total wash, c) placing the material into the wash basin, d) cycling the wash through at least one Wash/Rinse cycle and e) drying the washed material.

2. The method of claim 1 wherein the material is a polyester containing phosphate antistats.

3. The method of claim 1 wherein the concentration of IPA is 2.5% by volume of the wash.

4. The method of claim 1 wherein the wash is cycled through two Wash/Rinse cycles.

5. The method of claim 2 wherein said phosphate antistats comprise about 0.04% of the total material by weight.

6. The method of claim 1 wherein said material is comprised of polyester felt fibers having phosphate antistats coated onto the fibers.

7. The method of claim 1 wherein the material is used to store ink which is to be delivered to a recording head in a printing system.

8. The method of claim 1 wherein the softened water is heated to a temperature of between 120° F. and 150° F.

9. The method of claim 1 wherein the IPA concentration is between 2% and 5% by volume.

10. A method for cleaning a material used to store ink, said material containing phosphate antistats, comprising the steps of:

a) filing a wash basin with tap water, b) adding an IPA to the wash basin to form an $H_2O$/IPA solution with a concentration of IPA between 1% and 10% by volume, c) adding a chelating agent to a concentration of between 0.1% and 5% of the $H_2O$/IPA solution to form a wash, d) placing the material into the wash basin, e) cycling the wash through at least one Wash/Rinse cycle and f) drying the washed material.

11. The method of claim 10 wherein said chelating agent is a member selected from the group consisting of alkylene diamine tetra carboxylic acids.

12. The method of claim 11 wherein the chelating agent is ethylene diamine tetra-acetic acid in a mixture of acid form and trisodium salt, the mixture having a pH of about 8.

13. The method of claim 10 wherein the IPA is 2.5% of the wash.

14. The method of claim 10 wherein the wash is cycled through two Wash/Rinse cycles.

15. The method of claim 10 wherein said phosphate antistats comprise about 0.04% of the total material weight.

16. A cleaning method for reducing phosphate antistats from a felted polyester material, including the steps of:

a) washing the material in a wash solution comprising softened water and an IPA concentration of 1–10% by solution volume, and b) drying the washed material.

17. A cleaning method for reducing phosphate antistats from a felted polyester material including the steps of:

a) washing the material in a wash comprising mainly tap water and IPA concentration of 1–10% by tap water volume, b) adding a chelating to a concentration of between 0.1 and 5% of the wash, c) cycling the wash through at least one wash/rinse cycle and d) drying the washed material.

* * * * *